US006295688B1

(12) United States Patent
Sayles et al.

(10) Patent No.: US 6,295,688 B1
(45) Date of Patent: Oct. 2, 2001

(54) TOILET BOWL CLEANER

(76) Inventors: Christine Elizabeth Sayles; Stephen Charles Edward Sayles, both of 38 Whyteacres, Court Bush Road, Whyteleafe, Surrey CR3 0BJ (GB)

( * ) Notice: Subject to any disclaimer, the term of this patent is extended or adjusted under 35 U.S.C. 154(b) by 0 days.

(21) Appl. No.: 09/112,369

(22) Filed: Jul. 9, 1998

(51) Int. Cl.[7] ..... A46B 11/04; A46B 17/00

(52) U.S. Cl. ..... 15/210.1; 15/104.94; 15/257.01; 206/209

(58) Field of Search ..... 15/104.94, 210.1, 15/251.01; 206/15.2, 15.3, 209, 225, 226, 233, 361; 4/661; 24/545, 555, 562

(56) References Cited

U.S. PATENT DOCUMENTS

| | | | | |
|---|---|---|---|---|
| 2,448,603 | * | 9/1948 | Kevin et al. | 206/209 |
| 2,668,974 | * | 2/1954 | Jaeger | 15/210.1 |
| 2,755,497 | * | 7/1956 | Greacen, Jr. | 15/104.94 |
| 2,922,180 | * | 1/1960 | Render | 15/257.01 |
| 3,383,158 | * | 5/1968 | Leland | 15/210.1 |
| 3,495,918 | * | 2/1970 | Leland | 15/210.1 |
| 3,723,998 | * | 4/1973 | Wehr | 4/661 |
| 4,031,673 | * | 6/1977 | Hagelberg | 15/210.1 |
| 4,987,634 | * | 1/1991 | Weihrauch | 15/210.1 |
| 5,471,697 | * | 12/1995 | Daconta | 15/210.1 |
| 5,488,748 | * | 2/1996 | Koch | 15/210.1 |
| 5,592,713 | * | 1/1997 | Rones | 15/104.94 |
| 5,772,015 | * | 6/1998 | Musiel et al. | 206/209 |

FOREIGN PATENT DOCUMENTS

| | | | |
|---|---|---|---|
| 0 710 524 | | 6/1954 | (GB) . |
| 0 738 299 | | 10/1955 | (GB) . |
| 0 835 277 | | 5/1960 | (GB) . |
| 1 374 272 | | 11/1974 | (GB) . |
| WO 87/00411 | | 1/1987 | (WO) . |
| 87/00022 | * | 1/1987 | (WO) ..... 15/210.1 |

* cited by examiner

*Primary Examiner*—Robert J. Warden, Sr.
*Assistant Examiner*—Theresa T. Snider
(74) *Attorney, Agent, or Firm*—Bartlett & Sherer

(57) ABSTRACT

A toilet bowl cleaner in the form of a reusable wand which may be mounted on a support when not in use. The support may include a reservoir for a disinfectant liquid. The lower end of the wand is a push fit into the core of a hollow cylindrical head of absorbent material. When any soiling matter has been removed from the bowl's surfaces by the head, the head is dislodged from the end of the wand by contact with the lip of the bowl to fall by gravity into the bowl, from where it is removed by flushing. An alternative head may be made from a rigid material for scraping hardened matter from the bowl's surface. A device for facilitating removal of the head from the wand is also provided.

13 Claims, 2 Drawing Sheets

FIG. 1
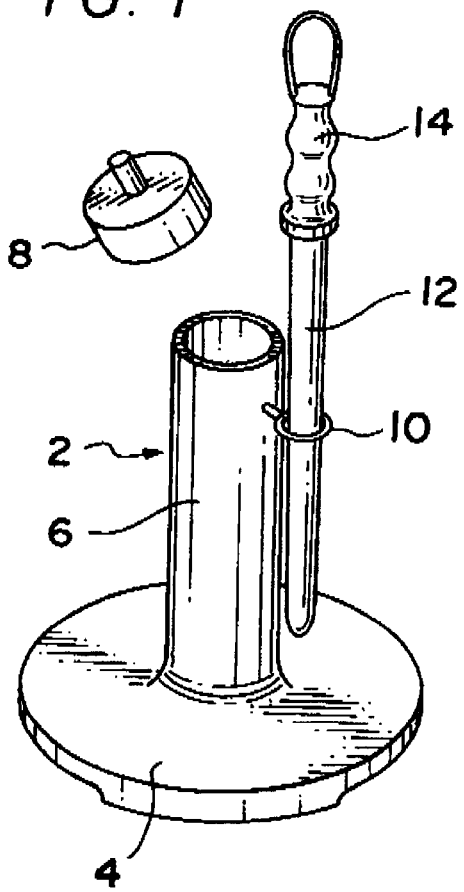
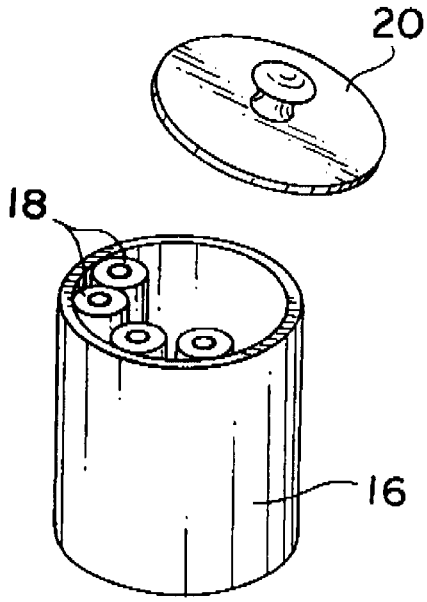
FIG. 2
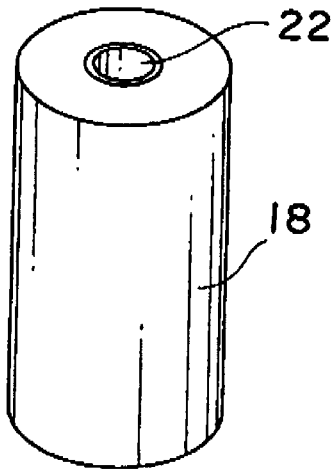
FIG. 3

TOILET BOWL CLEANER

FIELD OF THE INVENTION

This invention relates to a toilet bowl cleaner, by which is meant a manual device by means of which the flushed interior surfaces of a toilet bowl may be cleansed of any adhering faecal or like soiling matter.

DESCRIPTION OF RELATED ART

Toilet cleaners are known in the form of brushes with angled heads of stiff bristles. After use, the brush is intended to be inserted in a stand which usually shrouds the brush head.

The disadvantage of using such known brushes is the difficulty of removing soil from the brush head after use. If the flow of flushing water has stopped or lessened before the brush head has been rinsed clean, the delay in waiting for the cistern to refill is such as to discourage users from cleansing the brush with a second flush. Thus the brush may be replaced on its support while imperfectly clean, leading to aesthetic and sanitary objections.

SUMMARY OF THE PRESENT INVENTION

The present invention aims at overcoming this problem by using a toilet bowl cleaner having a detachable head for preferably one-time use, and which is preferably disposable down the toilet in the manner of tampons.

Accordingly, the present invention provides a toilet bowl cleaner which is as claimed in the appended claims.

BRIEF DESCRIPTION OF DRAWINGS

The present invention will now be described by way of example, with reference to the accompanying drawings, in which:

FIG. 1 is an isometric view of the support and reusable wand of the present invention;

FIG. 2 is a similar view of a lidded container for the disposable cleaner heads for the wand shown in FIG. 1;

FIG. 3 is a view, on a larger scale, of a typical cleaner head;

DESCRIPTION OF EMBODIMENTS PREFERRED

AT THE TIME OF FILING FOR THIS PATENT

Figure 4:
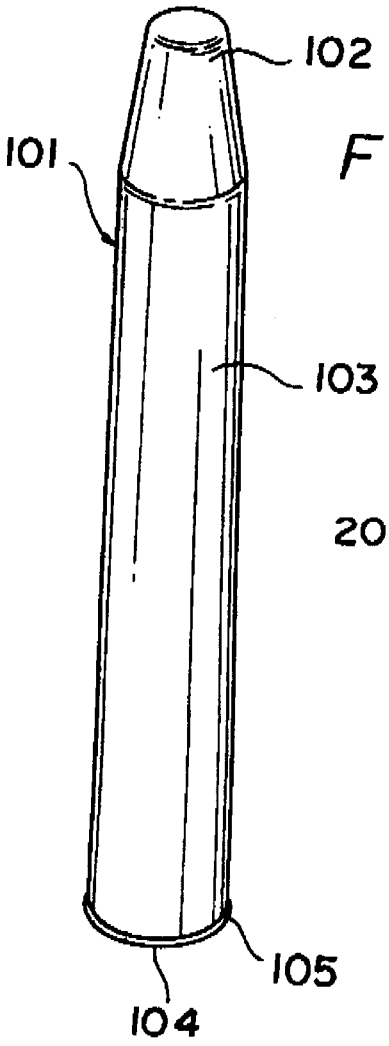
FIG. 4 is a front view of an alternative head.

In the support 2 shown in FIG. 1, the base 4 is intended to rest stably on the floor or other flat surface in the toilet room. Extending upwardly from the base is a hollow container 6 for a disinfectant liquid, the container being usually kept closed by a well-fitting lid 8, to restrict access to the contents of the container by inquisitive children.

Projecting from one side of the container 6 is a ring support 10 for a reusable wand 12 of ceramic, plastics or other non-porous material. The lower end of the wand has a slightly tapered end portion with a rounded nose which normally contacts the dished inner surface of the base 4 when the wand is in its upright, ready-to-use, position.

The upper end of the wand ends in a handle 14, which may be a closed loop or other construction giving the user a comfortable and secure grip on the wand. A closed loop is particularly preferred as it enables the wand 12 to be suspended from a hook away from young children if desired.

Forming part of the toilet cleaner set is a holder 16 for several one-time usable heads 18, as shown in FIG. 2. The holder has a lid 20, for aesthetic and practical reasons. Although shown as separate from it in FIGS. 1 and 2, the holder 16 may of course be integral with, or otherwise connected to, the support 2.

Each head 18, as shown more clearly in FIG. 3, has a hollow core 22 of uncoated card or like degradable material. The inner diameter of the core is a push fit on the cylindrical lower end of the wand 12. Wrapped on, or otherwise applied to, the core 22 is a thick layer of absorbent degradable material, such as of woven or felted cotton, paper tissue, cellulose or like inexpensive material.

When the cleaner is to be used, the lid 20 is removed from the holder 16, and the wand 12 is separated from its support. The blunt end of the wand is inserted into the core of one of the heads 18, and the wand pushed downwardly to impale the head on it. The wand and head are then removed, and the head may be dipped into the disinfectant in container 6 prior to the wand being used to wipe the head over the internal surfaces of the toilet bowl as necessary whereby the disinfectant is released from the head in use.

When the bowl is clean, the head is displaced from the end of the wand, as by the wand being dragged over the inner lip of the bowl, to allow the soiled head to fall by gravity into the toilet bowl, from where it is flushed away. When the head has been removed from it, the wand may have its lower end dipped again in the disinfectant liquid before being put into its resting position on the support.

It is much preferred that the head should be used only once and then disposed of down the toilet. However, it is possible that the head could be constructed for multiple uses. It is also possible that the head could be made non-degradable in which case alternative arrangements would have to be made for its disposal, for example by incineration or by placing it in a bucket for disposal with the household refuse.

It should be noted that the wand 12 may be used on its own to dislodge faecal material and to break up any blockages in the toilet bowl, for example a blockage caused by an accumulation of toilet paper. The use of the wand 12 is far more effective than attempting to use a conventional toilet brush the bristles of which merely become covered in small pieces of tissue in a most unwholesome manner.

The head 18 is preferably of cylindrical shape as shown. However, it could also be of any other convenient shape.

Referring to FIG. 4 there is shown an alternative head generally identified by reference number 101.

The head 101 comprises a hollow, generally cylindrical body portion 103 with a tapered end portion 102. The tapered end portion 102 is tapered preferably into a chisel shape. The other end 104 of the body portion has an open end suitable for receiving a wand 12.

The head 101 is preferably made from a stiff paper or other degradable material, advantageously suitable for being flushed down a toilet.

In use, wand 12 is inserted into the head 101 through opening 104 for approximately 3 to 5 cm. The lower end of the wand 12 is then usable for scraping faeces which has adhered to the bowl of a toilet.

It is envisaged that the head 101 may be coated in a solvable glue in order to harden the head especially the tapered portion, whilst remaining degradable. The degrading time is preferably between 30 to 60 minutes. The coating is preferably non-toxic.

The head 101 may then be removed from the wand 12 by placing the rim 105 against the rim of the toilet bowl whereupon upward movement of the wand 12 causes the head 101 to drop into the toilet bowl, whereupon the head 101 may be flushed away.

Figure 6:
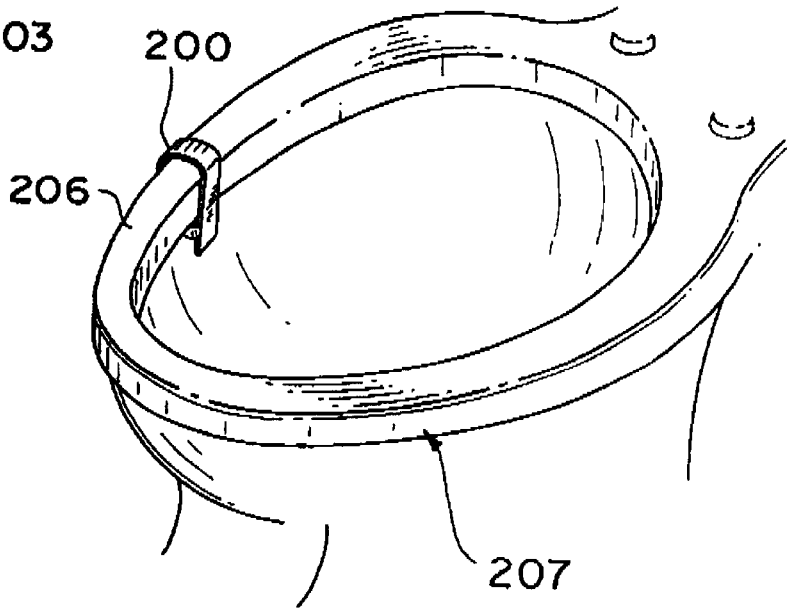
FIG. 6 is an isometric view of the device of FIG. 5 in situ on the rim of a toilet bowl.
Figure 5:
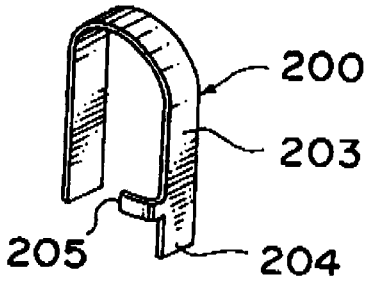
FIG. 5 is an isometric view of a device for facilitating the removal of a head from a wand.

Referring to FIG. 5 and 6 there is shown a device for facilitating the removal of a head from a wand generally identified by reference number 200.

The device 200 comprises a U-shaped member 203 made from a flexible plastic material, an extended member 204 for receiving the rim of a head on a wand and a lip 205 for receiving the rim 206 of a toilet bowl 207. The extended member 204 preferably has a relatively sharp lower end and is made from a relatively rigid plastic material.

Before use, the device 200 is pushed over the rim 206 of a toilet bowl 207. The lip 205 snaps under the rim 206 which substantially prevents any upward movement applied to the extended member 204. The extended member 204 overhangs into the toilet bowl 207.

In use, when it is desired to remove a head 18, 101 from a wand 12, a lip of the head 18, 101 is placed under the extended member 204 whereupon upward movement of the wand 12 causes the head 18, 101 to drop into the toilet bowl 207, whereupon the head 18, 101 may be flushed away.

It will thus be seen that this invention provides an inexpensive and simple solution to the problem of cleaning the inner surface of toilet bowls, in a way which prevents any of the soiling material accidentally leaving the interior of the bowl.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realised that changes are possible within the scope of this invention and it is further intended that each element or step recited in any of the following claims is to be understood as referring to all equivalent elements or steps. The following claims are intended to cover the invention as broadly as legally possible in whatever form it may be utilised. The invention claimed herein is new and novel in accordance with 35 U.S.C. §102. The invention claimed herein is not obvious in accordance with 35 U.S.C. §103 and satisfies the conditions for patentability in §103. This specification and the claims that follow are in accordance with all of the requirements of 35 U.S.C. §112.

What is claimed is:

1. A toilet bowl cleaner comprising:

(a) a wand, said wand having first and second ends;

(b) a hollow head of material removably attached to one of said ends of said wand;

(c) said removable hollow head comprising a hollow core having first and second ends, and a body of absorbent material attached to said core and extending from said first end to said second end of said core.

2. The bowl cleaner of claim 1 wherein both of said core and said absorbent material are composed of degradable material.

3. A toilet bowl cleaner as claimed in claim 1, further comprising a support for supporting said wand when not in use.

4. The toilet bowl cleaner of claim 3 including reservoir means for containing a disinfectant and being of a size and shape for receiving said body of absorbent material.

5. The toilet bowl cleaner of claim 4 wherein said reservoir means are connected to said support for providing a unitary structure comprising said wand, said support and said reservoir.

6. The toilet bowl cleaner of claim 1 wherein said one end of said wand is tapered and of a size and shape to removably engage said hollow core.

7. A toilet bowl cleaner as claimed in claim 1, further comprising, as a kit, a device for facilitating the removal of said head from said wand, said device being of a size and shape such as to be attached to said toilet bowl.

8. A toilet bowl cleaner as claimed in claim 7, wherein said device comprises a U-shaped portion for fitment around a rim of a toilet bowl.

9. A toilet bowl cleaner as claimed in claim 8, wherein said device further comprises a lip portion for restraining said U-shaped portion when an upward force is applied thereto.

10. A toilet bowl cleaner as claimed in claim 9, wherein said device comprises an extended member against which said head may be placed in order to facilitate removal thereof from said wand.

11. A toilet bowl cleaner system comprising:

(a) a wand, said wand having a handle end and an opposite end;

(b) said opposite end including a tapered portion;

(c) a cleaning head;

(d) said cleaning head comprising hollow core means and absorbent material wrapped around said core means;

(e) the size and shape of said hollow core means being such as to frictionally and removably engage said tapered portion of said wand for cleaning the toilet and for removal by pulling said tapered portion of said wand out of said hollow core;

(f) the size of said head being sufficiently small such as to be flushed down the toilet without clogging; and (g) each of said hollow core means and said absorbent material being composed of degradable material so as to both degrade after being flushed down the toilet.

12. The toilet bowl cleaning system of claim 11 further including as a kit:

(a) a support structure for supporting said wand when not in use;

(b) a container for containing a disinfectant liquid; and (c) said container being sufficiently large to receive said head when not in use, and said container being connected to said support structure as an integral unit.

13. The cleaning system and kit of claim 12 further including:

(a) a second container; and (b) said second container being of a size and shape to receive and contain a plurality of said cleaning heads for individual connection and use with said wand.

* * * * *